US007431571B2

(12) United States Patent
Kim et al.

(10) Patent No.: US 7,431,571 B2
(45) Date of Patent: Oct. 7, 2008

(54) NOISE REDUCTION MUFFLER FOR HERMETIC ROTARY COMPRESSOR

(75) Inventors: Young-Jong Kim, Kyoungsangnam-Do (KR); Jong-Hun Ha, Kyoungsangnam-Do (KR); Byung-Ha Ahn, Busan (KR); Kwang-Ho Kim, Kyoungsangnam-Do (KR); Sang-Myung Byun, Kyoungsangnam-Do (KR)

(73) Assignee: LG Electronics Inc. (KR)

( * ) Notice: Subject to any disclaimer, the term of this patent is extended or adjusted under 35 U.S.C. 154(b) by 426 days.

(21) Appl. No.: 10/492,747

(22) PCT Filed: Nov. 16, 2001

(86) PCT No.: PCT/KR01/01963

§ 371 (c)(1),
(2), (4) Date: Apr. 14, 2004

(87) PCT Pub. No.: WO03/042543

PCT Pub. Date: May 22, 2003

(65) Prior Publication Data

US 2004/0241012 A1 Dec. 2, 2004

(51) Int. Cl.
*F04B 39/00* (2006.01)

(52) U.S. Cl. ..... 417/312; 62/296; 181/403

(58) Field of Classification Search ..... 181/214, 181/403, 236, 282, 264, 224, 212, 207, 198; 417/312; 62/296

See application file for complete search history.

(56) References Cited

U.S. PATENT DOCUMENTS 6,398,520 B2 * 6/2002 Han ..... 417/312

FOREIGN PATENT DOCUMENTS

| | | |
|---|---|---|
| JP | 02-061375 | 3/1990 |
| JP | 02-196189 | 8/1990 |
| KR | 2000050706 A * | 8/2000 |

OTHER PUBLICATIONS

Office Action issued by European Patent Office on Jul. 2006 in connection with corresponding European patent application No. 01 274 715.0-2315.

* cited by examiner

*Primary Examiner*—Devon Kramer
*Assistant Examiner*—Vikansha Dwivedi
(74) *Attorney, Agent, or Firm*—Ostrolenk, Faber, Gerb & Soffen, LLP

(57) ABSTRACT

A muffler for a hermetic rotary compressor including a muffler body forming a plurality of noise reducing spaces in which refrigerant gas flows; a discharge port formed on the muffler body so as to be located on the nose reducing spaces side; and a guide cover coupled to an inner wall of the muffler body in radial direction for guiding the refrigerant gas flowing in the noise reducing spaces to be discharged to the discharge port, and therefore the noise generated during the discharge of the compressed refrigerant gas to inside a sealed chamber, and a flow resistance for the discharged refrigerant gas is reduced, whereby the electric power consumption is reduced, and the structure and assembling processes can be simplified.

35 Claims, 10 Drawing Sheets

NOISE REDUCTION MUFFLER FOR HERMETIC ROTARY COMPRESSOR

TECHNICAL FIELD

The present invention relates to a muffler for a hermetic rotary compressor, and particularly, to a muffler for a hermetic rotary compressor by which noise generated during processes of sucking, compressing a refrigerant gas in a compression space of a cylinder, and discharging the gas into a sealed chamber, and a structure can be simple.

BACKGROUND ART

In general, a compressor is an apparatus for compressing fluid, and divided into a rotary compressor, a reciprocating compressor, and a scroll compressor according to a compressing method.

FIG. 1 is showing an embodiment of a hermetic rotary compressor among those compressors. In the hermetic rotary compressor, when a driving motor 20 which is installed on a sealed chamber is operated, a rotating axis 30 which is coupled to a rotor 21 of the driving motor 20 is rotated, and then an eccentric part 31 on the rotating axis 30 is eccentrically rotated in a compression space P of a cylinder 40 located on lower part of the driving motor 20.

The eccentric part 31 of the rotating axis 30 is rotated in the compression space P of the cylinder 40, accordingly, a rolling piston 45 which is coupled to the eccentric part 31 is line contacted to the cylinder 40, and the rolling piston 45 performs circular movement in the compression space P of the cylinder 40 in the state that it is line contacted to a vane (not shown) which is coupled to the cylinder 40 slidably.

The rolling piston 45 performs circular movement in the compression space P of the cylinder 40, and accordingly, the compression space P of the cylinder 40 which is divided by the vane (not shown) is partitioned into a compression area and a suction area. In addition, the refrigerant gas is sucked through a suction port 41 installed in the cylinder 40 and compressed, and discharged through a discharge port 42 disposed on one side of the cylinder 40. And then the compressed refrigerant gas is discharged to inside of the sealed chamber 10 through a discharge hole 51 formed on an upper bearing 50 between two bearings, that is, an upper bearing 50 and a lower bearing 60 which are coupled to both sides of the cylinder 40 as covering the cylinder 40.

At that time, a discharge valve 52 which is coupled to upper part of the upper bearing 50 opens/closes the discharge hole 51 corresponding to changing of the compression space P of the cylinder 40 into the compression area and the discharge area.

In addition, the compressed refrigerant gas discharged into the sealed chamber 10 flows through the inside of the sealed chamber 10, and is discharged to outer side of the sealed chamber 10 through a discharge tube 70 which is coupled to upper part of the sealed chamber 10. At that time, some of lubricant for lubricating driven parts in the sealed chamber 10 is discharged together with the compressed refrigerant gas.

On the other hand, as the processes of sucking, compressing, and discharging the refrigerant gas in the compression space P of the cylinder 40 are repeated, a severe noise is generated because of pressure pulsation of the refrigerant gas which is discharged from the compression space P of the cylinder 40 and of an impact noise generated during opening/closing the discharge valve 52, and therefore a muffler F is installed so as to minimize the noise.

The muffler is installed on one of the upper bearing 50 or the lower bearing 60 coupled to upper and lower parts of the cylinder 40, through which the compressed refrigerant gas is discharged, and the muffler F is installed on the upper bearing 50 is shown in FIG. 1.

Unexplained reference numeral 22 designates a stator, and 61 designates a bolt for coupling.

On the other hand, FIGS. 2 and 3 are showing an embodiment of the muffler (hereinafter, referred to as the first muffler) which is installed on the conventional hermetic rotary compressor.

As shown therein, the first muffler comprises: a muffler body 80 formed as a cap so as to cover upper part of the upper bearing 50; a plurality of bolt coupling parts contacted to upper surface of the upper bearing 50 and depressed as certain area on upper circumference of the muffler body 80 so that a coupling bolt 61 can be coupled; and a penetrating hole 82, through which a part of the upper bearing 50 is penetrated, on upper central part of the muffler body 80; a convex part 83 relatively protruded by the bolt coupling part 81 and having inner space.

In addition, two discharge ports 84 are formed on upper part of the muffler body 80, and a bending tube 85 having a predetermined length is coupled inside the muffler body 80 so as to communicate with the discharge ports 84. In addition, the bending tube 85 is located so as to be in a line with a circular arc direction on the outer circumferential surface of the muffler body 80.

The first muffler is coupled by the coupling bolt 61 so as to cover the upper bearing (or the lower bearing), and the refrigerant gas discharge through the discharge hole 51 of the upper bearing 50 goes through muffling space formed by the bolt coupling part 81 and the convex part 83 of the upper bearing 50 and then discharged to the inner part of the sealed chamber 10 through the bending tube 85 and the discharge port 84. Therefore, the noise generated by the pressure pulsation and by the opening/closing the valve can be reduced.

On the other hand, FIGS. 4 and 5 are showing another embodiment of the conventional muffler (hereinafter, referred to as the second muffler) installed on the hermetic rotary compressor.

As shown therein, the second muffler comprises: a muffler body 90 formed as a cap so as to cover upper part of the upper bearing 50; a plurality of bolt coupling parts 91 depressed as a certain area on upper circumference of the muffler body 90 so as to being contacted to upper surface of the upper bearing 50 and being coupled to the coupling bolt; a penetrating hole 92, through which a part of the upper bearing 50 is penetrated and inserted, on upper central part of the muffler body 90; and a convex part 93 relatively protruded by the bolt coupling part 91 and having inner space.

In addition, two discharge ports 94 are formed on upper surface of the convex part 93 of the muffler body 91, and a pair of upper/lower covers 95 and 96 of hemisphere or half-elliptic shape which cover more than half of the discharge port 94. In addition, fluid passages formed by the upper and lower covers 95 and 96 which cross each other are located so as to be in line with the circular arc direction on outer circumferential surface of the muffler body 90.

The second muffler is coupled by the coupling bolt 61 so as to cover the upper bearing (or the lower bearing), and the compressed refrigerant gas which is discharged through the discharge hole 51 of the upper bearing 50 goes through muffling spaces formed by the bolt coupling part 91 of the convex part 93 of the upper bearing 50 and then discharged to inner side of the sealed chamber 10 through the discharge port 94 and the upper/lower covers 95 and 96. Therefore the noise generated by the pressure pulsation and the valve opening/closing can be reduced.

On the other hand, the noise generated during the processes of sucking, compressing, and discharging the refrigerant gas in the compression space P of the cylinder 40 is generated because the refrigerant gas which is compressed in the compression space P of the cylinder 40 is discharged to the inner side of the sealed chamber having large inner volume through the discharge hole 51 having relatively small diameter.

Therefore, in the first and second mufflers which are covered by the upper bearing 50 including the discharge hole 51, the refrigerant gas of high pressure which is discharged through the discharge hole 51 goes through the muffling spaces of the first and second muffler, and the bending tube or the fluid passage formed by the upper/lower covers 95 and 96, and then the noise is reduced. In addition, the arrow line shown in FIGS. 2 and 4 represents the flowing of the refrigerant gas which flows inside the muffler.

However, the noise is generated while the refrigerant gas of high pressure is discharged to inner side of the sealed chamber 10 through the muffling spaces, the bending tube 85 which is located so as to be in line with the circular arc direction of the outer circumferential surface, and the discharge port 84. In addition, the passage resistance is increased in the process of flowing the refrigerant gas of high pressure through the bending tube 85, and therefore the inputted electric source is increased. Also, the bending tube 85 is coupled to inner side of the muffler body 80 so as to communicate with the discharge port 84, and therefore the structure is complex and assembling process becomes difficult.

On the other hand, the refrigerant gas of high pressure discharged through the discharge hole 51 of the upper bearing passes through the muffling spaces and is discharged to the inside of the sealed chamber 10 through the discharge port 94 which forms the passage so as to be in line with the circular arc direction on the outer circumferential surface of the muffler body 90, and through between the upper and lower covers 95 and 96, and the noise is generated during the processes. Also, the upper cover 95 and the lower cover 96 are coupled to inner upper side and to outer upper side of the muffler body 90 so as to cover the discharge port 94, and therefore the structure is complex and assembling process becomes difficult.

Also, in case of the first and second mufflers, the bending tube 85 and the upper/lower covers 95 and 96 are formed so as to be in line with the circular arc direction on the outer circumferential surface of the muffler body 80 and 90, that is, so as to be corresponded with the flowing direction of the refrigerant gas, and therefore, the pulsation noise of the refrigerant gas and the impact noise of the valve is transmitted to the inner side of the sealed chamber 10.

DISCLOSURE OF THE INVENTION

Therefore, it is an object of the present invention to provide a muffler for a hermetic rotary compressor by which noise generated during processes of sucking, compressing refrigerant gas in a compression space in a cylinder and discharging the gas into a sealed chamber, and structure can be simple.

To achieve the object of the present invention, there is provided a muffler for a hermetic rotary compressor comprising: a muffler body coupled to a cylinder so as to cover a compression space of the cylinder and coupled to a bearing including discharge hole through which refrigerant gas of high pressure compressed in the compression space of the cylinder for forming a plurality of noise reducing spaces with surfaces of the bearing; a discharge port formed on the muffler body so as to be located on the side of the noise reducing spaces; and a guide cover located on the noise reducing spaces and coupled to an inner wall of the muffler body in radial direction for guiding the refrigerant gas flowing in the noise reducing spaces to the discharge port.

MODES FOR CARRYING OUT THE PREFERRED EMBODIMENTS

Hereinafter, the muffler for the hermetic rotary compressor according to the present invention will be described with reference to Figures as follows.

The muffler for the hermetic rotary compressor according to the present invention is coupled so as to cover a compression space P of a cylinder, and coupled to a bearing having a discharge hole through which the refrigerant gas of high pressure compressed in the compression space P of the cylinder.

Figure 1:
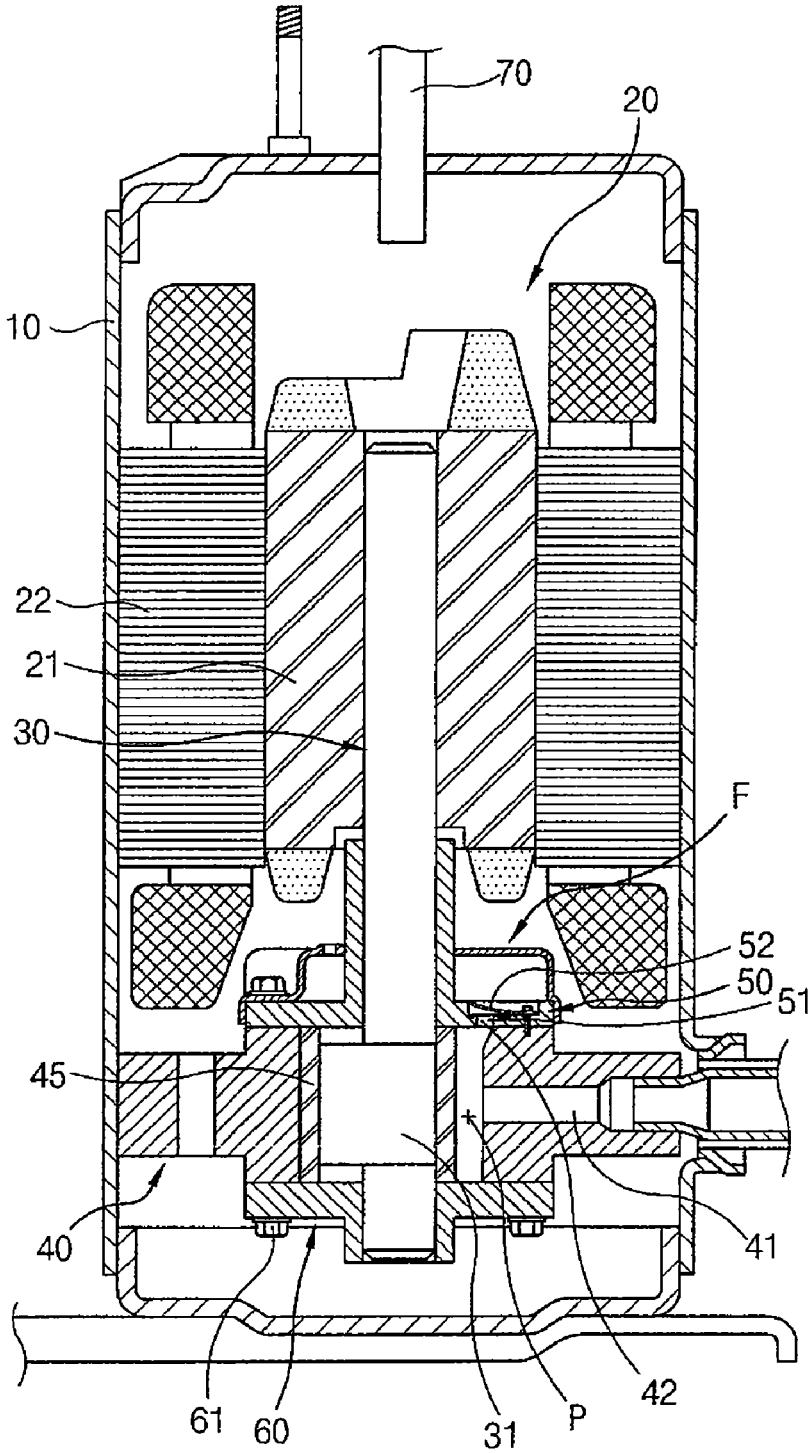
FIG. 1 PRIOR ART
FIG. 1 is a cross-sectional view showing an embodiment of general hermetic rotary compressor.
Figure 2:
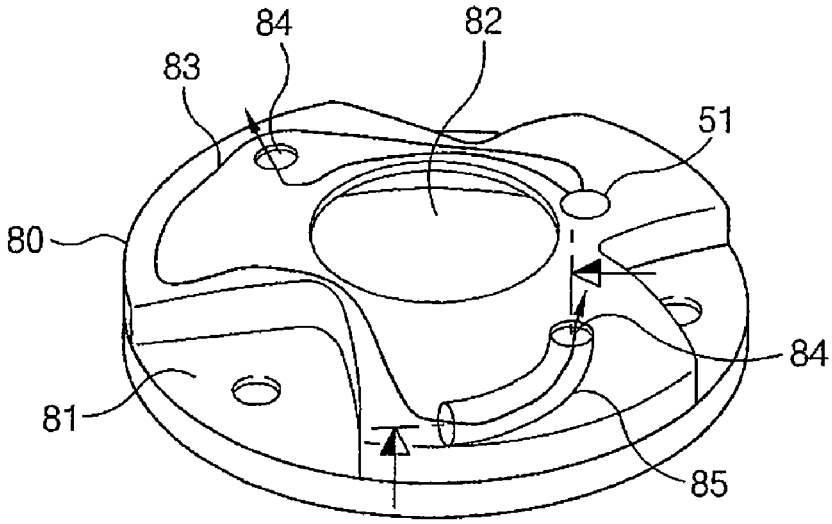
FIG.2 PRIOR ART
FIG. 2 is a perspective view showing an embodiment of a conventional muffler for the hermetic rotary compressor.
Figure 3:
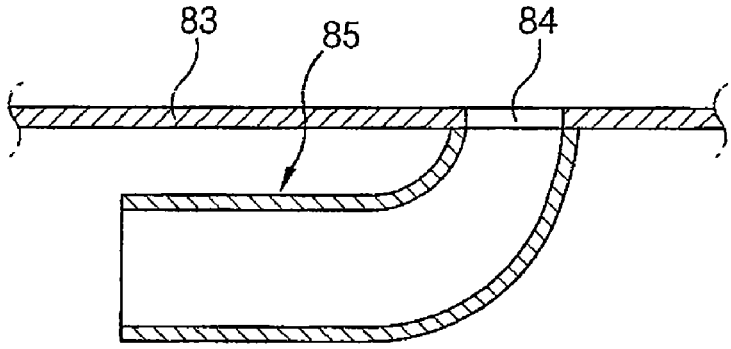
FIG.3 PRIOR ART
FIG. 3 is a cross-sectional view showing the muffler in FIG. 2.
Figure 4:
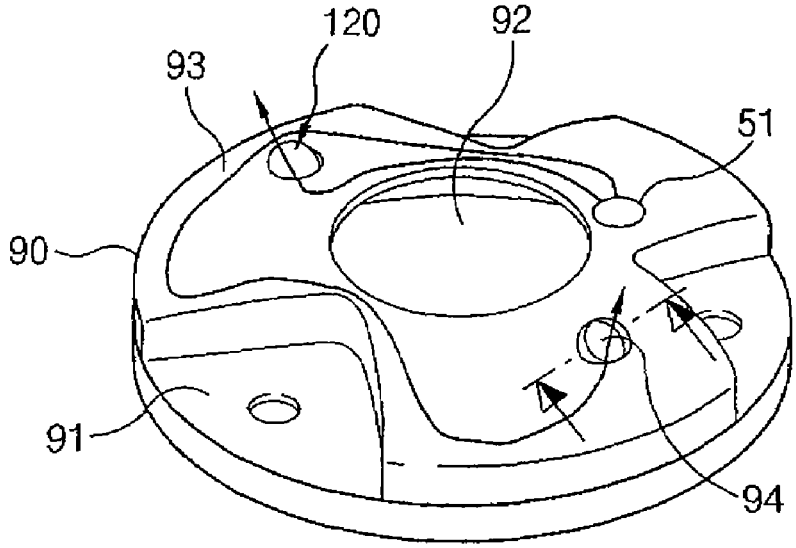
FIG.4 PRIOR ART
FIG. 4 is a perspective view showing another embodiment of the conventional muffler for the hermetic rotary compressor.
Figure 5:
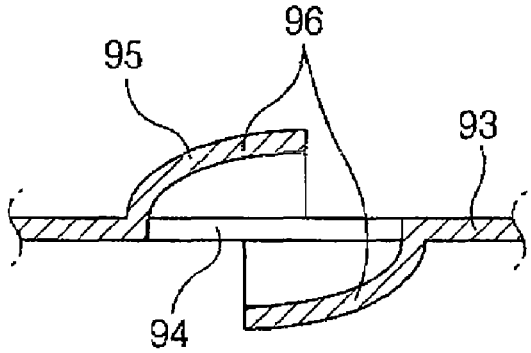
FIG.5 PRIOR ART
FIG. 5 is a cross-sectional view showing the muffler in FIG. 4.
Figure 6:
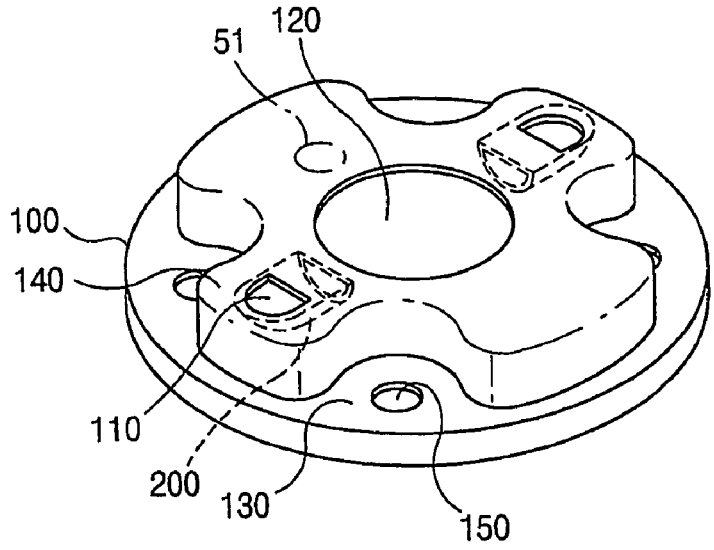
FIG. 6 is a perspective view showing a first embodiment of a muffler for a hermetic rotary compressor according to the present invention.
Figure 7:
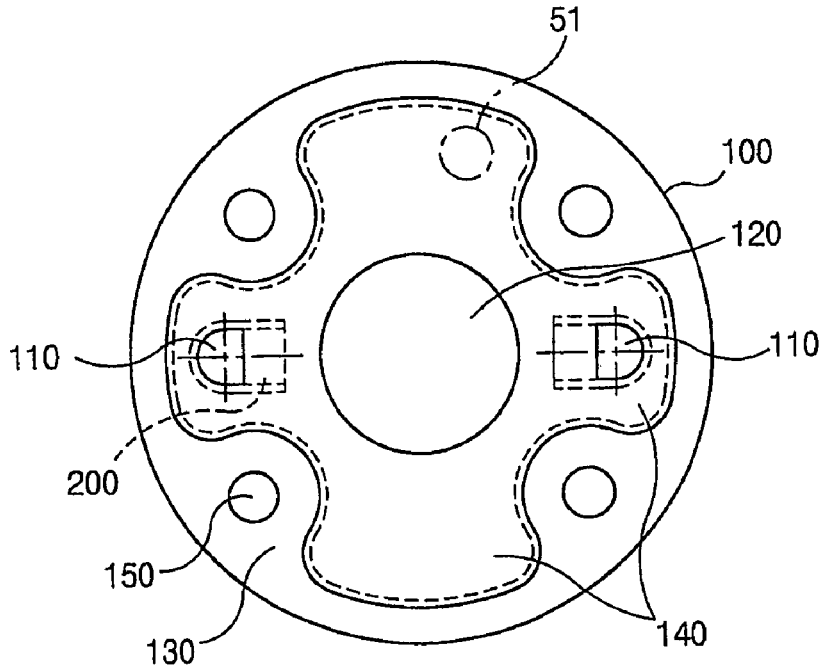
FIG. 7 is a plan view showing the muffler for the hermetic rotary compressor according to the present invention.

FIGS. 6 and 7 are showing a first embodiment of the muffler for the hermetic rotary compressor, as shown therein, the muffler for the hermetic rotary compressor comprises a discharge port 110 formed on upper surface of a muffler body 100 of cap shape.

The muffler body 100 is formed as a cylinder having a predetermined thickness and length with sealed one end, and an insertion hole 120 having a predetermined inner diameter so that a part of the upper bearing 50 can be inserted is formed on upper center part of the muffler body 100.

In addition, a plurality of bolt coupling parts 130 which are depressed as a predetermined area are disposed on upper circumference part of the muffler body 100 with a certain distance therebetween so that the upper surface of the upper bearing 50 is contacted and the coupling bolt 61 is coupled thereto. Therefore, the upper surfaces located between the bolt coupling parts 130 are relatively protruded by the bolt coupling parts 130, and then these become a plurality of protruded parts 140.

In addition, screw holes 150 corresponding the number of the bolt coupling parts 130 are formed on center part of the bolt coupling parts 130.

And it is desirable that a virtual circle which connects inner ends of the bolt coupling parts 130 is larger than the inner diameter of the insertion hole 120.

Also, a plurality of noise reducing spaces are formed by respective inner spaces of the protruded parts 140 and by the upper surface of the upper bearing 50, and the noise reducing spaces are communicated with each other. And the discharge hole 51 of the upper bearing 50 is located on of the noise reducing spaces.

The discharge port 110 is formed on one or more protruded part 140 among the plurality of protruded parts 140 forming the noise reducing spaces.

On Figure, two discharge ports 110 are respectively formed on two protruded parts 140 among four protruded parts 140.

The discharge ports 110 are disposed to have phase difference of 180°, and the discharge hole 51 of the bearing is located inside the protruded part 140 which is located between two protruded parts including the discharge ports 110.

In addition, a guide cover 200 is coupled inner upper side of the noise reducing spaces formed by the respective protruded parts 140 having the discharge ports 110. Preferably, the guide cover 200 is integrally formed on a surface of the protrude part 140.

The guide cover 200 is coupled to inner wall of the muffler body 100, that is, inner wall of the protruded part 140 so as to be located in the noise reducing space and include the discharge port 110, and it guides the refrigerant gas flowing in the noise reducing space to be escaped to the discharge port 110 with the inner wall of the muffler body 100.

That is, the guide cover 200 is coupled so that a central line in length direction of the guide cover 200 is located radially for the center axis of the muffler body 100.

Figure 8:
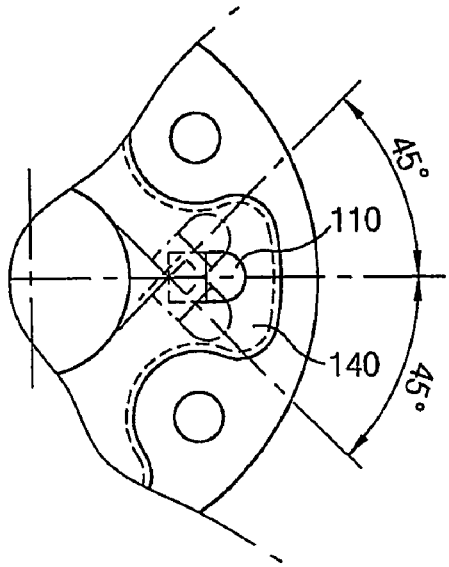
FIG. 8 is a plan view showing an installation range of a guide cover included in the muffler for the hermetic rotary compressor according to the present invention.

In addition, as shown in FIG. 8, the guide cover 200 is formed so that the central line in length direction is located within a range of −45°~45° making a center point on inner end as a standard.

Figure 9:
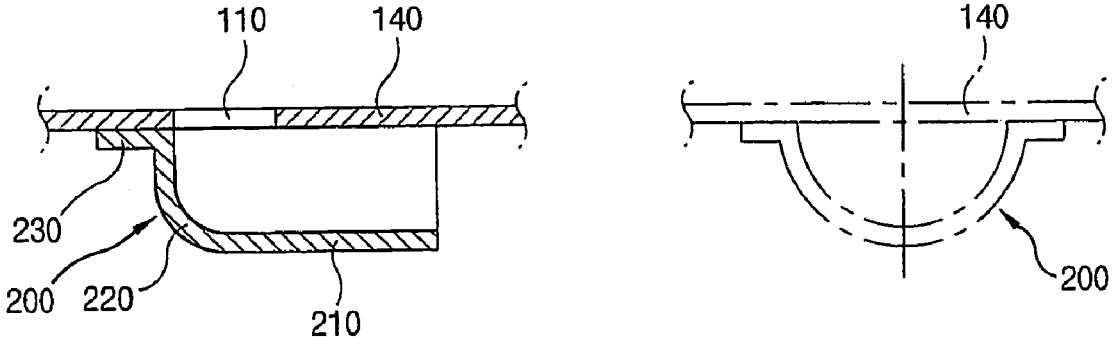
FIG. 9 is a partial cross-sectional view and a projected view of right side of the guide cover included in the muffler for the hermetic rotary compressor according to the present invention.

In addition, as shown in FIG. 9, the guide cover 200 comprises: a passage part 210 having a predetermined thickness and length and cross section formed as a semicircle; a cover part 220 formed extended from the passage part 210 on the one side end of the passage part 210 as a hemisphere shape for covering the discharge port 110; and a coupling part 230 formed as extending boundary part of the passage part 210 and the cover part 220 and bent for coupling to the inner wall of the muffler body 100.

And, the discharge port 110 is located far from the center of the muffler body 100, and an end of the passage part 210 of the guide cover 200 is located close to the center of the muffler body 100.

Figure 10:
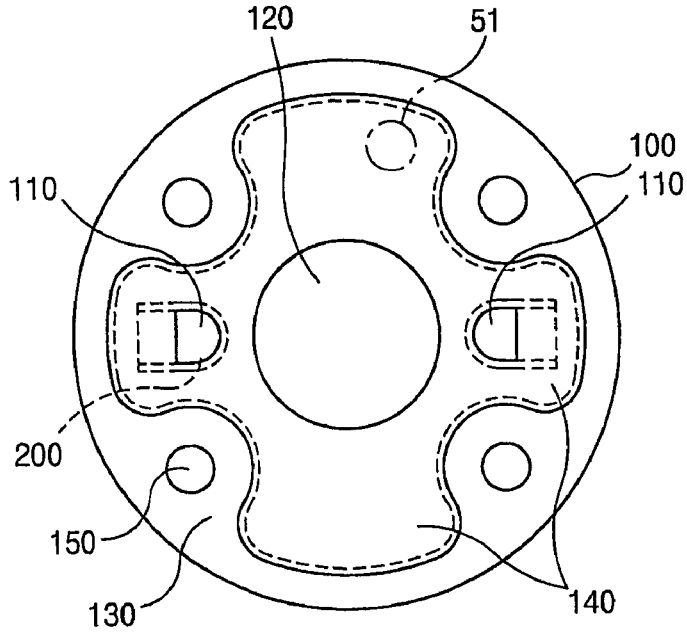
FIG. 10 is a plan view showing a second embodiment of the muffler for the hermetic rotary compressor according to the present invention.

Also, as a second embodiment of the present invention, the discharge port 110 is located close to the center of the muffler body 100, and the end of the passage part 210 of the guide cover 200 is located toward the opposite position to the center of the muffler body 100, as shown in FIG. 10.

Figure 11:
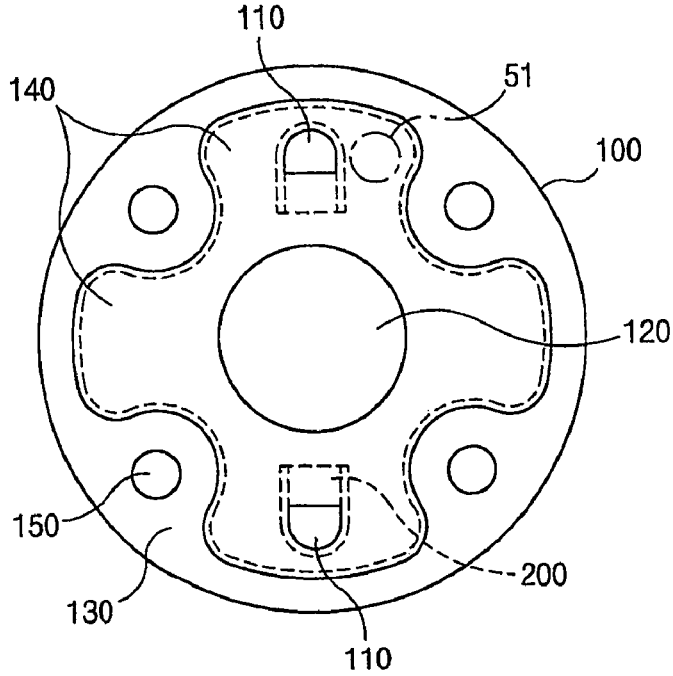
FIG. 11 is a plan view showing a third embodiment of the muffler for the hermetic rotary compressor according to the present invention.

Also, as a third embodiment of the present invention, four protruded parts 140 are disposed on the muffler body 100, and the discharge ports 110 are formed on two protruded parts 140 which are located on same line among those four protruded parts 140. In addition, the discharge hole 51 of the upper bearing 50 is located inside one of the two protruded parts 140. And the guide cover 200 is coupled to inner side of the protruded parts 140 on which the discharge ports 110 are formed, as shown in FIG. 11.

Figure 12:
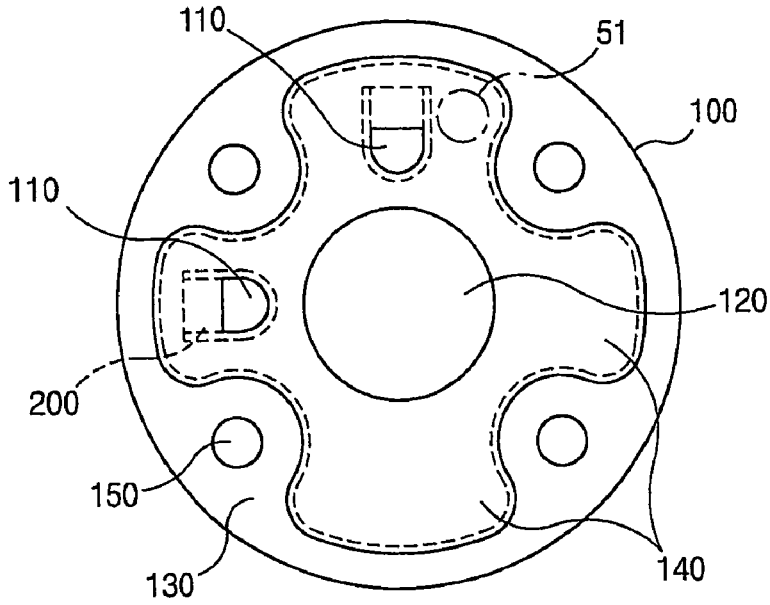
FIG. 12 is a plan view showing a fourth embodiment of the muffler for the hermetic rotary compressor according to the present invention.

Also, as a fourth embodiment of the present invention, four protruded parts 140 are formed on the muffler body 100, and the discharge hole 51 of the upper bearing 50 is located on one of the four protruded parts 140, as shown in FIG. 12. In addition, the discharge port 110 is formed on the protruded part 140 beside the above protruded part 140 having the discharge hole 51, and the guide cover 200 is coupled inside the protruded parts 140 on which the discharge ports 110 are formed. That is, the two discharge ports 110 have phases of 90° for the center of the muffler body 100.

Figure 13:
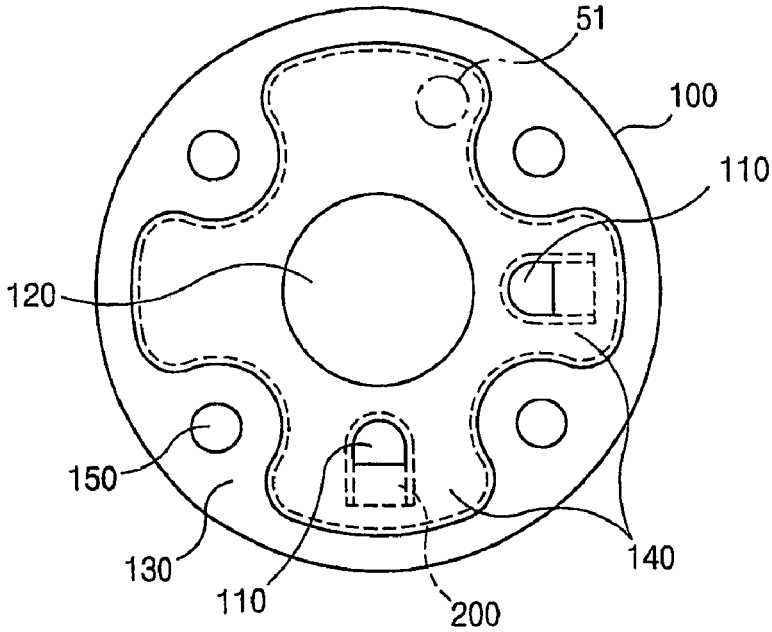
FIG. 13 is a plan view showing a fifth embodiment of the muffler for the hermetic rotary compressor according to the present invention.

Also, as a fifth embodiment of the present invention, four protruded parts 140 are formed on the muffler body 100, and the discharge ports 110 are formed on two protruded parts 140 which are adjacent to each other among those four protruded parts 140, as shown in FIG. 13. And the discharge hole 51 of the upper bearing 50 is located on the protruded part 140 on which the discharge port 110 is not formed.

That is, the two discharge ports 110 have phases of 90° for the center of the muffler body 100. In addition, the guide cover 200 is coupled to inside the protruded parts 140 on which the discharge ports 110 are formed.

Figure 14:
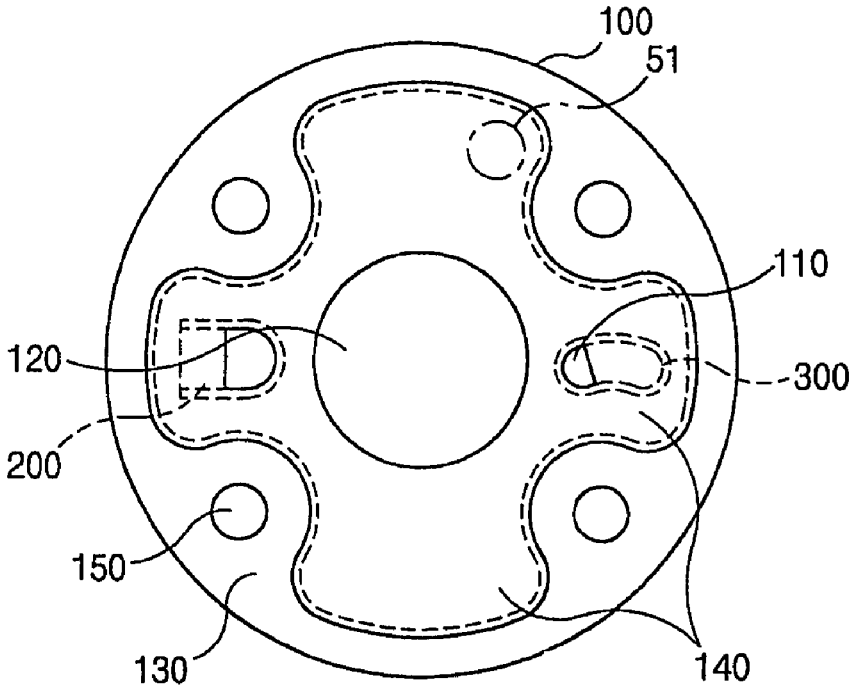
FIG. 14 is a plan view showing a sixth embodiment of the muffler for the hermetic rotary compressor according to the present invention.

Also, as a sixth embodiment of the present invention, four protruded parts 140 are disposed on the muffler body 100, and the discharge ports 110 are formed on two protruded parts 140 which are located on a same line among those protruded parts 140, as shown in FIG. 14. And the discharge hole 51 of the upper bearing 50 is located on one of the protruded parts 140 which are located between above the two protruded parts 140 on which the discharge ports 110 are formed.

In addition, the guide cover 200 is coupled to inside of the protruded parts 140 on which the discharge ports 110 are formed, and a curved guide cover 300 is coupled inside the protruded part 140 on which another discharge port 110 is formed.

Figure 15:
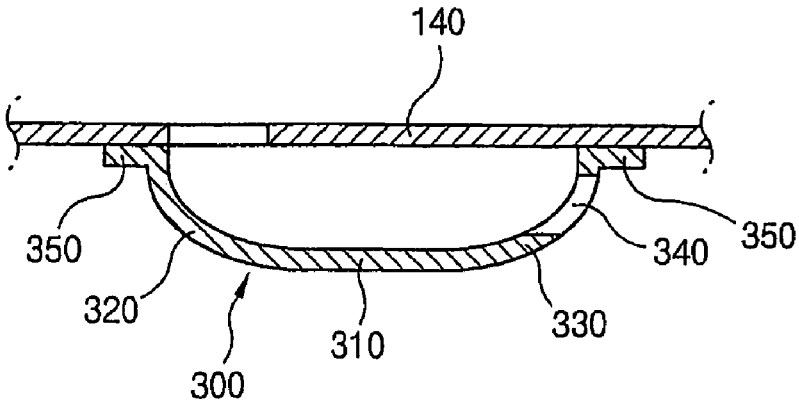
FIG. 15 is a cross-sectional view showing a curved guide cover included in the muffler for the hermetic rotary compressor according to the present invention.

As shown in FIG. 15, the curved guide cover 300 comprises: a passage part 310 having predetermined thickness, a predetermined curved line, and cross section of semicircle shape; a first cover part 320 extended on one side end of the passage part 310 for covering the discharge port 110; a second cover part 330 extended on other side end of the passage part 310 as a semicircle shape; a penetrating hole 340 formed on the side second cover part 330; and a coupling part 350 bent and extended on boundary parts of the passage part 310, first and second cover parts 320 and 330 and coupled to the inner wall of the muffler body 100. Preferably, the curved guide cover 300 is integrally engaged to the muffler body 100 by welding or the like.

In addition, the length direction of the curved guide cover 330 is located on radial line of the muffler body 100.

Figure 16:
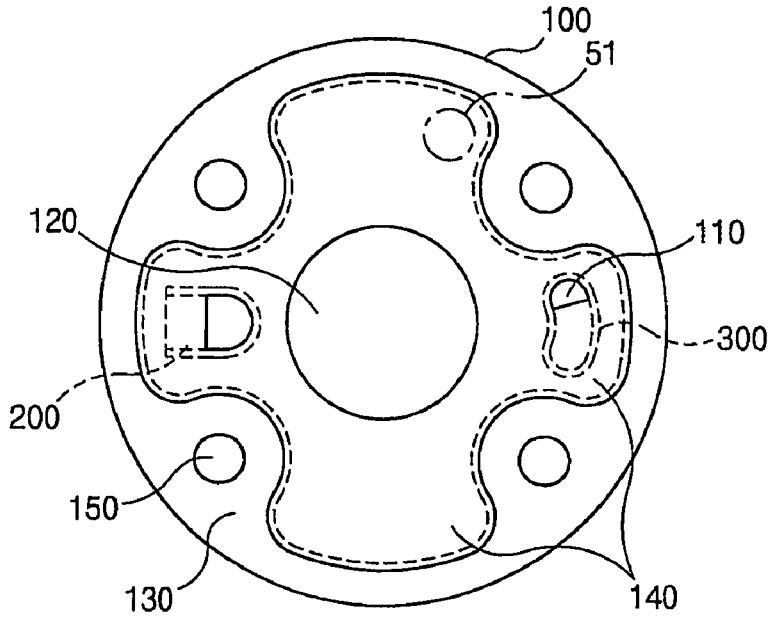
FIG. 16 is a plan view installing state of the curved guide cover included in the muffler of the hermetic rotary compressor according to the present invention.

Also, as another example of the sixth embodiment, the curved part of the guide cover 300 is located parallel with the circular arc direction of the outer circumferential surface of the muffler body 100, as shown in FIG. 16.

In the present invention, the noise reducing spaces can be applied to cases that there are two or three protruded parts besides the above embodiment. In addition, the present invention is not limited above embodiments, but various modifications can be made in order to minimize the noise and simplify the structure.

Hereinafter, the operation and effects of the muffler for the hermetic rotary compressor according to the present invention will be described as follows.

The muffler for the hermetic rotary compressor according to the present invention is assembled such that the muffler body 100 is coupled so as to cover the upper bearing 50 which is coupled to the cylinder 40.

At that time, a part of the upper bearing 50, that is, an axis supporting part (not defined by a reference numeral) is inserted into the insertion hole 120 on the muffler body 100, and at the same time, the bolt coupling parts 130 is contacted and supported by the upper surface of the upper bearing 50.

In addition, the coupling bolt 61 penetrates and couples to the screw hole 150 formed on the bolt coupling part 130 of the muffler body 100, and therefore the cylinder 40 and the upper bearing 50 are coupled, and the muffler body 100 is coupled.

Figure 17:
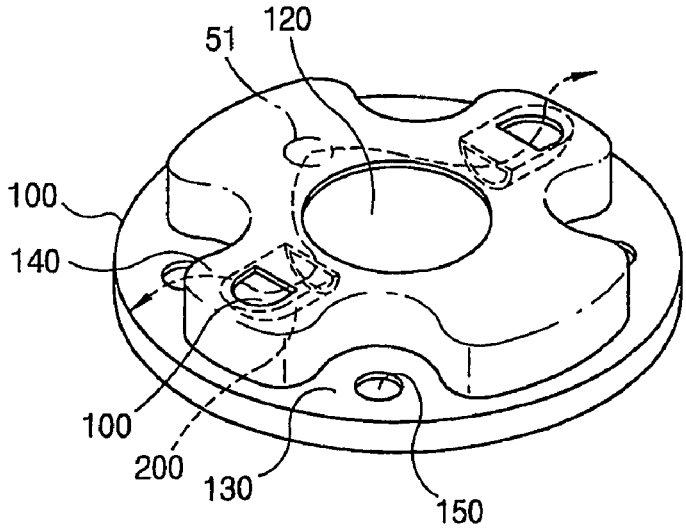
FIG. 17 is a perspective view showing an operating state of the muffler for the hermetic rotary compressor according to the present invention.

In the state above, when the refrigerant gas of high pressure which is compressed in the compression space P of the cylinder 40 is discharged through the discharge hole 51 of the upper bearing 50, the discharged refrigerant gas is flowed through the plurality of noise reducing spaces, as shown in FIG. 17.

The refrigerant gas flowing in the plurality of noise reducing spaces is discharged to outside, that is, inside the sealed chamber 10 through the passage and the discharge port 110 formed by the guide cover 200 and the inner wall of the muffler body 100 in one noise reducing space in which the guide cover 200 is disposed.

During the above process, the refrigerant gas of high pressure which was compressed in the compression space P of the cylinder 40 is discharged to the plurality of noise reducing spaces through the discharge hole 51 of the upper bearing 50, and the pressure pulsation and impact noise cause by the valve opening/closing are discharged with the refrigerant gas. And at that time, the pressure pulsation and the impact noise are reduced while being discharged from the discharge hole 51 having small volume to the noise reducing spaces having big volume. In addition, the refrigerant gas which have undergone the plurality of noise reducing spaces is discharged to inside of the sealed chamber 10 through the passage of radial direction formed by the guide cover 200 and the inner wall of the muffler body 100 and through the discharge port 110, and then the noise, that is, resonance is compensated by interference of the passage of radial direction.

Also, according to the present invention, the structure of the guide cover 200 which is coupled to the inner wall of the muffler body 100 so as to include the discharge port and forms the passage through which the refrigerant gas flows is simple, and the coupling process is simple. Also, the passage formed by the guide cover 200 and the inner wall of the muffler body 100 is simplified, whereby the flow resistance for the refrigerant gas is reduced.

Figure 18:
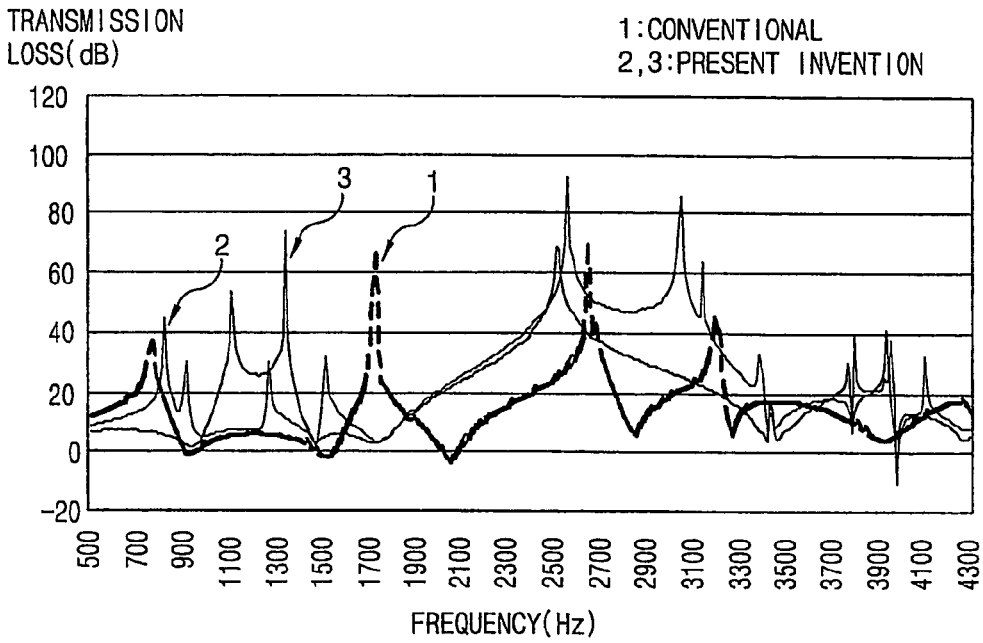
FIG. 18 is a graph for comparing transmission losses of the conventional muffler with the muffler according to the present invention.

FIG. 18 is a graph measuring noise generation after the muffler according to the present invention is installed on the hermetic rotary compressor, as shown therein, the transmission loss(dB) of the muffler according to the present invention is larger than that of the conventional muffler, whereby the noise reducing effect is greater than that of the conventional art.

Herein, the value of the transmission loss is a logarithm for a ration between a pressure on entrance portion of the muffler and a pressure on an outlet after passing through the muffler. And it means that the larger the value of the transmission loss, the greater the noise reducing effect is.

Figure 19:
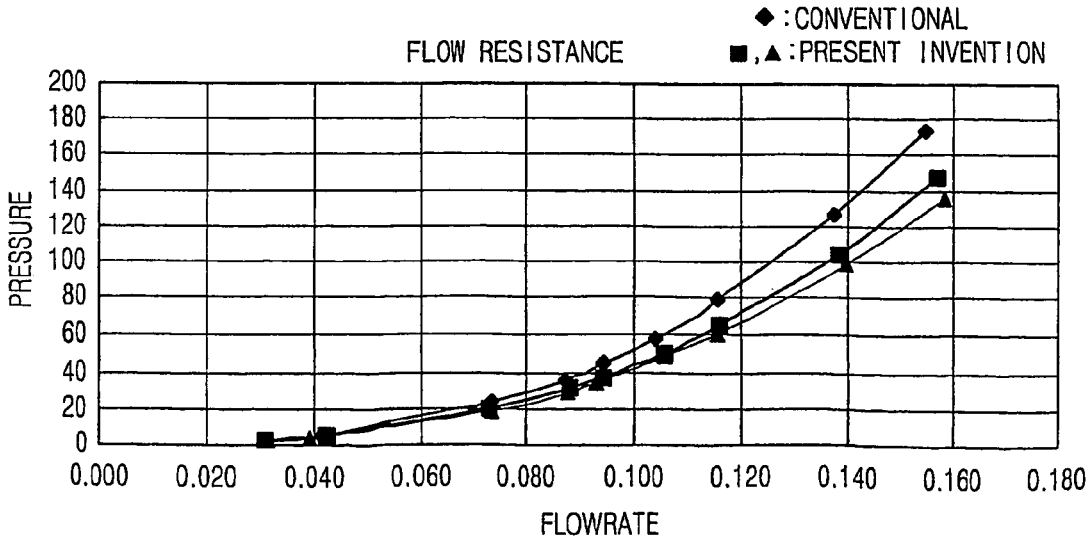
FIG. 19 is a graph for comparing flow resistance of the conventional muffler with the muffler according to the present invention.

Also, FIG. 19 is a graph measuring the flow resistance after the muffler according to the present invention and the conventional muffler are installed on the hermetic rotary compressors respectively, as shown therein, the flow resistance of the present invention is smaller than that of the conventional art, and therefore input electric current is used less than that of the conventional art in order to discharge same amount of refrigerant gas.

As described above, the muffler for the hermetic rotary compressor which is installed on a refrigerator or on an air conditioner is able to minimize the noise which is generated when the refrigerant gas sucked and compressed in the compression space P of the cylinder is discharged into the sealed chamber, and then the reliability of the compressor can be increased. In addition, the flow resistance for the refrigerant gas is reduced and then the flowing of the refrigerant gas is made smoothly, and therefore the electric power consumption can be reduced. Also, the structure and the coupling process of the muffler are simplified, and therefore, the assembling productivity can be increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

The invention claimed is:

1. A muffler for a hermetic rotary compressor comprising:

a muffler body coupled so as to cover a compression space of a cylinder, and covering one side surface of a bearing including a discharge hole through which refrigerant gas of high pressure compressed in the compression space is discharged, whereby forming a noise reducing space, in which the refrigerant gas discharged through the discharge hole flows, with the one side surface of the bearing;

a discharge port formed on the muffler body so as to be adjacent to the noise reducing space; and a guide cover located in the noise reducing space and coupled to an inner wall of the muffler body for guiding the refrigerant gas flowing in the noise reducing space to the discharge port with the inner wall of the muffler body, wherein the guide cover has an elongated shape and extends over the discharge port to an entrance of the guide cover in a radial manner with respect to a center axis of the muffler body.

2. The muffler of claim 1, wherein the guide cover is at an angle with respect to a radial axis that is perpendicular with the center axis, the angle being within a range of ±45 degrees from the radial axis.

3. The muffler of claim 1, wherein two discharge ports and two guide covers are disposed on protruded parts defining noise reducing spaces inside the muffler body, and the two discharge ports and two guide covers are located to have phases of 180° with each other.

4. The muffler of claim 3, wherein the discharge hole of the bearing is located inside one of two protruded parts between the two protruded parts on which the discharge ports and the guide covers are formed.

5. The muffler of claim 3, wherein the discharge hole of the bearing is located inside one of the two protruded parts on which the discharge ports and the guide covers are formed.

6. The muffler of claim 1, wherein two discharge ports and two guide covers are disposed on the protruded parts defining noise reducing spaces inside the muffler body, and the two discharge ports and the two guide covers are located to have phase of 90° with each other.

7. The muffler of claim 6, wherein the discharge hole of the bearing is located inside one of two other protruded parts which are adjacent to the two protruded parts on which the discharge ports and the guide covers are formed.

8. The muffler of claim 6, wherein the discharge hole of the bearing is located inside one of the two protruded parts on which the discharge ports and the guide covers are formed.

9. The muffler of claim 1, wherein the guide cover comprises:

a passage part having a predetermined thickness, a predetermined straight line length, and sectional area formed as a semicircle;

a cover part extended on one side end of the passage part for covering the discharge port; and a coupling part bent and extended on boundary parts of the passage part and of the cover part for coupling to the inner wall of the muffler body.

10. The muffler of claim 9, wherein the discharge port is located far from the center of the muffler body, and an end of the passage part on the guide cover is located close to the center of the muffler body.

11. The muffler of claim 9, wherein the discharge port is located close to the center of the muffler body, and an end of the passage part on the guide cover is located far from the center of the muffler body.

12. The muffler of claim 1, wherein the guide cover is coupled to inside of the protruded part on which the discharge port is formed, and a curved guide cover is coupled to inside of the protruded part on which another discharge port is formed.

13. The muffler of claim 12, wherein a curved line direction of the curved guide cover is located to be parallel with a circular arc direction of outer circumferential surface of the muffler body.

14. The muffler of claim 12, wherein the curved guide cover comprises:

a passage part having a predetermined thickness, a certain length, and a section formed as a semicircle;

a first cover part of hemisphere shape extended on one side end of the passage part for covering the discharge port;

a second cover part of hemisphere shape extended on the other side end of the passage part;

a penetrating hole formed on the side of the second cover part; and a coupling part bent and extended on boundary parts of the passage part, first and second cover parts for coupling to the inner wall of the protruded part consisting the muffler body.

15. The muffler of claim 12, wherein an end of the guide cover is located toward the opposite position to the center of the muffler body.

16. The muffler of claim 12, wherein an end of the curved guide cover is located toward the opposition to the center of the muffler body.

17. The muffler of claim 13, wherein the guide cover and the curved guide cover are integrally formed with the muffler body.

18. The muffler of claim 3, wherein an end of the guide cover is located toward the opposition position to the center of the muffler body.

19. The muffler of claim 3, wherein the guide covers are integrally fixed to the muffler body.

20. The muffler of claim 6, wherein an end of the guide cover is located toward the opposition position to the center of the muffler body.

21. The muffler of claim 6, wherein the guide covers are integrally fixed to the muffler body.

22. The muffler of claim 1, wherein the guide cover is integrally formed on the muffler body.

23. A muffler for a compressor, comprising:

a body having a coupling part to be attached to the compressor and having a plurality of protruded parts defining a noise suppression chamber therein to receive refrigerant gas from the compressor via a discharge hole of the compressor; and a guide cover attached to an inner surface of one of the protruded parts and extending radially with respect to a center axis of the body, the guide cover having one end that covers a discharge port formed on an upper portion of the protruded part and having an opposing end with an inlet that is separated from and substantially perpendicular to the discharge port, and the guide cover and the inner surface of the protruded part defining, from the one end to the opposing end, a passage having a semi-circular cross-section.

24. The muffler of claim 23, wherein two protruded parts that oppose each other respectively have the discharge port and the guide cover.

25. The muffler of claim 23, wherein two protruded parts that are adjacent to each other respectively have the discharge port and the guide cover.

26. The muffler of claim 23, wherein the guide cover is attached to a protruded part that is above the discharge hole of the compressor.

27. The muffler of claim 23, wherein the guide cover is attached to a protruded part that is not above the discharge hole of the compressor.

28. The muffler of claim 23, wherein the body has four protruded parts forming a clover-like configuration.

29. The muffler of claim 23, wherein the guide cover is at an angle within a range of ±45 degrees with respect to a radial axis extending perpendicularly from the center axis of the body.

30. The muffler of claim 23, wherein the inlet faces towards the center axis of the body.

31. The muffler of claim 23, wherein the inlet faces away from the center axis of the body.

32. The muffler of claim 23, wherein the body and the guide cover are implemented for a refrigerator or an air conditioner.

33. The muffler of claim 23, further comprising:

an additional guide cover attached to an inner surface of another protruded part, the additional guide cover being curved lengthwise to correspond a curvature of the coupling part, the additional guide cover having one end that covers a discharge port formed on an upper portion of the another protruded part and having an opposing end with an inlet that is separated from and substantially perpendicular to the discharge port, and the additional guide cover and the inner surface of the another protruded part defining, from the one end to the opposing end, a passage having a semi-circular cross-section.

34. The muffler of claim 33, wherein the inlet faces away from the center axis of the body.

35. The muffler of claim 33, wherein the body, the guide cover, and the additional guide cover are implemented for a refrigerator or an air conditioner.

* * * * *